United States Patent [19]

Jung et al.

[11] Patent Number: 4,511,007

[45] Date of Patent: Apr. 16, 1985

[54] LOCKING DEVICE FOR A TOOL WITH TELESCOPICALLY DISPLACEABLE PARTS

[75] Inventors: Thomas Jung, Isernhagen; Gerhard Heidemann, Celle, both of Fed. Rep. of Germany

[73] Assignee: Norton Christensen, Inc., Salt Lake City, Utah

[21] Appl. No.: 521,877

[22] Filed: Aug. 10, 1983

[30] Foreign Application Priority Data

Sep. 14, 1982 [DE] Fed. Rep. of Germany ..... 3234003

[51] Int. Cl.[3] ..... E21B 4/14

[52] U.S. Cl. ..... 175/297; 175/99

[58] Field of Search ..... 175/99, 296–298, 175/302, 304, 318, 321; 166/237, 217, 178

[56] References Cited

U.S. PATENT DOCUMENTS 2,634,102 4/1953 Howard ..... 175/296

2,678,805 5/1954 Sutliff ..... 175/297

*Primary Examiner*—Stephen J. Novosad

*Assistant Examiner*—Thuy M. Bui

*Attorney, Agent, or Firm*—Walter Fred

[57] ABSTRACT

A locking device for a tool with telescopically displaceable parts such as the various tools including a drilling jar used in the deep-well drilling art comprises thickened spindle portion (1) and a sleeve portion (2) with a displaceable sleeve (11) displaceable therein to and away from an axial abutment (17). The thickening of the spindle portion provided by a rigid tapered sleeve (3) with tapered end surfaces (5 and 6) and the sleeve (11) within the sleeve portion with an internal tapered surface (12) are coupled via locking balls (19) disposed for radial movement in an annular cage 20 between the rigid and displaceable sleeves 3 and 11. The sleeve (11) is held by an axial spring (16) in such a position that the balls come to lie axially between the axial abutment (17) and a region of the tapered sleeve (3) having a larger diameter and thereby form a constriction to the passage of the sleeve (3) of the spindle portion (11). This constriction can only be passed when the spindle and tapered sleeve (3) is pulled axially with an overload force sufficient to impress a radial force on the balls (19) which in turn forces an axial displacement of the internal tapered sleeve (11) disposed in the sleeve portion until the balls move radially sufficiently to allow passage of the larger diameter of the sleeve (3) and spindle to pass.

15 Claims, 3 Drawing Figures

LOCKING DEVICE FOR A TOOL WITH TELESCOPICALLY DISPLACEABLE PARTS

TECHNICAL FIELD

The invention relates to deep well drilling and particularly to a locking device for a jarring or other bore hole tool with telescopically displaceable parts in a drill string.

BACKGROUND ART

In the deep-well drilling art, numerous tools are used which can be brought from a first into a second working state by a telescopic displacement of two parts situated one inside the other. Frequently, the first working state is that state in which the normal drilling activity is effected, while the second state serves, depending on the nature of the tool, for example to lock a rotatable part, to unlock a jarring device or, as a component of a jarring device, to release the relative movement of spindle and sleeve as well as to activate security devices and to separate parts from the drill string.

A locking device always prevents the telescopic displacement from being caused accidentally by the axial forces usual in normal operation. The superimposition of an axial overload is necessary for the unlocking, after which the tool can then be brought into the second state.

A locking device has been proposed heretofore which locks the free relative movement of a spindle in a sleeve until an axial overload is reached.

The locking elements are formed by cylindrical rolling bodies which are embedded, axially and radially located, in pockets of a spindle portion. Counter elements cooperating with these locking elements consist of a part which is displaceable axially at any time against a spring and a part which is also displaceable axially but which, in the locking state, bears against a stop and comprises three arms pivotable radially inwards.

Both types of counter element have, at the adjacent sides, oblique surfaces which can slide on one another with inward or outward pivoting of the arms on variation in the mutual axial position of the counter elements. The pivotable arms of the counter elements have further oblique surfaces which bear against the rolling bodies in the locking state so that when a force is imposed on the spindle portion, the rolling bodies roll on the oblique surfaces of the pivotable arms as a result of which these are forced apart and by means of their other oblique surfaces which are in engagement with the further parts of the counter elements, displace these parts axially against the spring. The free axial displacement is rendered possible for the spindle portion with the rolling bodies by the parting of the pivotable arms. Forces up to a few $10^5$ N may be necessary as forces usual in deep-well drilling tools to unlock a locking device because they must differ sufficiently from the normal axial forces. The wear of the locking device and the material loading should be as low as possible. In the device according to U.S. Pat. No. 2,678,805 a severe bending stress of the pivotable arms occurs with axial tensile loading and in addition, during the unlocking operation, friction between the oblique surfaces of the pivotable arms and the oblique surfaces of the counter element displaceable axially against the spring causes excess wear.

It is an object of the present invention to provide an improved locking device for a tool consisting of telescopically displaceable spindle and sleeve portions so that the wear and the material stressing with the usual operational forces is low so that constant, reproducible results are delivered even after repeated locking and unlocking cycles.

SUMMARY OF THE INVENTION

The present invention is a locking device for a tool consisting of telescopically displaceable spindle and sleeve portions which together form an annular compartment in which locking elements resembling rolling bodies and counter elements provided with bevelled surfaces are disposed. Some of the counter elements are axially displaceable against a spring and others being axially located in the locking state, and in which the locking elements are movable radially in relation to the axis of the tool and the axially fixed part of the counter elements is made stiff with respect to radial stress.

The present invention is also a locking device for hydraulic drilling jars for deep-well drilling, consisting of a tubular sleeve portion and a spindle portion disposed therein with opposite impact shoulders. A chamber which is filled with a working fluid comprises a constriction and regions of larger diameter for a piston disposed on the spindle portion and valves which, when the piston passes through the constriction in one direction, throttle the emergence of the working fluid from the chamber and in the other direction allows free entrance into the chamber. Locking elements resembling rolling bodies and counter elements with bevelled surfaces are situated in an annular compartment. One part of the counter elements is axially displaceable against a spring and another part being axially located in the locking state, and in which, in the locking state, one pair of impact shoulders bears against one another and the piston is outside the constriction at a distance therefrom. Also, there is a damping section between the local position of the spindle member during the locking and on entry of the piston of the drilling jars into the constriction, the locking elements are movable radially in relation to the tool axis and the axially located portion of the counter elements is made stiff with respect to radial stress.

A mastering of the forces occurring with axial overload with simultaneous low wear is achieved as a result of the fact that, at the moment of unlocking, the parts between which the greatest compressive forces occur, can roll on one another. "Scouring" of the material between these parts is avoided as a result. Furthermore, bending stresses are avoided by the stiff construction of the axially located counter elements.

When the locking device is used in hydraulic drilling jars, a limitation of the displacement in the direction counter to the action of the locking is afforded by a pair of impact shoulders bearing against one another. As a result, a repeated bouncing of the locking and counter elements on one another is prevented from being able to occur in the event of alternating loads in the drilling operation. A damping section between the local position of the spindle portion during the locking and the entry of the piston of the drilling jars into the constriction prevents the piston from being able to move quickly into the constriction under the accelerating action of the axial overload which is still present after an unlocking operation and damage to seals being caused on the sudden braking by extreme excess pressure of the working fluid in the chamber.

In the event of restoring the drilling jars without renewed locking and subsequent application of force, the build-up of force is effected slowly so that peaks of excess pressure are then impossible.

The device can be made reversible or irreversible with regard to locking and unlocking, according to whether a sleeve disposed on the spindle portion is axially located or displaceable.

According to a further embodiment, the stop for the spring can be made axially displaceable, possibly by a device which can be actuated from outside the sleeve portion, so that the threshold value of the force at which an unlocking is effected is adjustable.

The locking elements are preferably in a cage which, on the one hand, renders possible easy assembly and dismantling as well as coaxial placing of the locking elements and on the other hand offers an area of support at the places where a sliding operation occurs.

In order to reduce the loading between the locking and counter elements, a plurality of these elements may be provided and axially disposed in adjacent layers. As a result, a far-reaching uniform distribution of the forces between the individual layers results.

BRIEF DESCRIPTION OF THE DRAWINGS

Embodiments of the present invention will now be described, by way of example, with reference to the accompanying drawings, in which.

DESCRIPTION OF THE PREFERRED EMBODIMENT(S)

Figure 1:
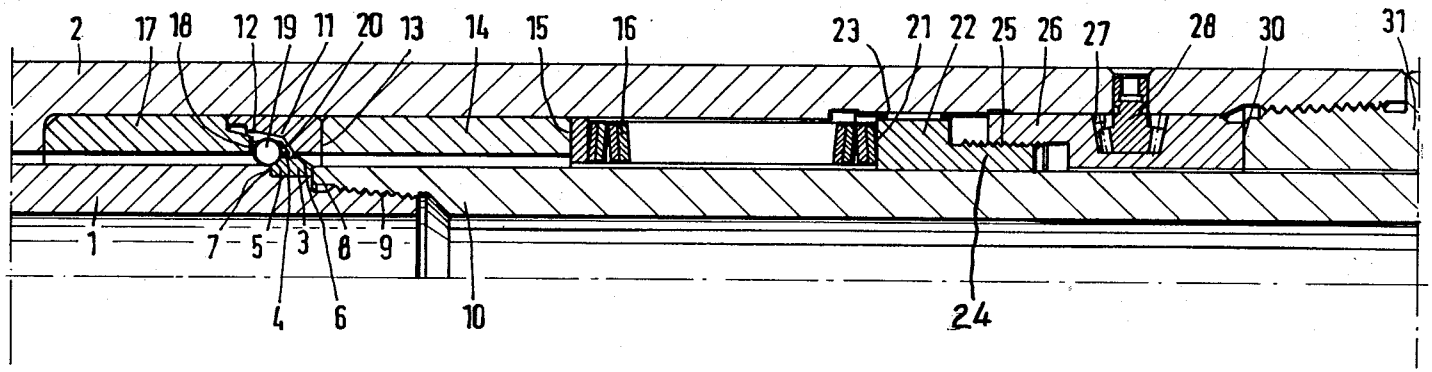
FIG. 1 is a cross-sectional view which shows the principle of a locking device which permits unlocking and reversible locking.

The locking device according to FIG. 1 comprises a spindle portion 1 which is mounted for telescopic displacement inside a sleeve portion 2 and carries an annular beveled or tapered sleeve 3. The sleeve or ring 3 is in an annular groove and is gripped between a groove wall or shoulder 7 and an end face 8 of a further spindle portion 10 connected to the spindle portion 1 by a thread 9. The sleeve 3 has a region 4 with a larger diameter in comparison with the spindle portion 1 and approaches the diameter of the spindle portion 1 at the two opposite ends through outer tapered component surfaces 5, 6. In the state illustrated in the drawing, the tapered component surface 5 of the sleeve 3 touches locking elements in the form of balls 19 disposed coaxially in a cage 20. In this position, the balls 19 still have radial play. On a displacement of the spindle portion 1 towards the left, the balls are urged outwards and then touch counter elements represented by an abutment 17 supported in the sleeve portion 2 and an axially displaceable sleeve 11. While the contact surface of the abutment 17 is formed by its end face 18 perpendicular to the tool axis, the contact surface with the sleeve 11 is a tapered component surface 12. A rear end face 13 of the sleeve 11 faces a spring means 16 and a gap therebetween being bridged by spacing members 14, 15. Axially displaceable stop means for the spring means 16 is formed by an end face 21 of a supporting adjustable sleeve 22 which is secured against rotation by means of a key 23 and ends in an externally threaded end portion or pin 24 at the side remote from the spring 16. The externally threaded pin 24 is in engagement with an internally threaded end portion 25 of an axially located but rotatable adjusting sleeve 26 which in turn is adjustable through a bevel gear rim 27 by means of a bevel pinion 28 which can be actuated and rotated from outside the sleeve portion 2. The opposite end of adjusting sleeve 26 bears against a threaded shoulder 30 of a further sleeve portion 31 screwed to the sleeve portion 2.

In the position illustrated, the locking device or means prevents a displacement of the inner spindle portion 1 towards the left in relation to the outer sleeve portion 2 with axial forces lying below a threshold value, because the locking elements 19 are prevented by the counter elements 11, 17 from giving way outwards and providing the cross-sectional area of passage needed by the tapered sleeve or ring 3.

When the axial force exceeds a predetermined threshold value, however, a radial component split-up via the tapered component surface 5 of the sleeve 3 and transmitted to the balls 19, causes, through a further component resolution at the tapered surface 12 of the sleeve 11, an axial displacement of the spring biased sleeve 11 spacers 15 and 16 in the direction of the opposing spring 16. During this operation, the balls 19 roll on the tapered surfaces 5 and 12 and give way radially outwards. As a result, the cross-sectional area of passage needed by the sleeve 3 is afforded and the spindle portion 1 can execute a free movement towards the left. The threshold value of the force leading to the unlocking can be varied and adjusted by axial displacement of the adjustable supporting sleeve 22. According to the type, size and hardness or stiffness of the spring 16, an adjustment may be necessary, with which the free displacement travel of the sleeve 11 up to the beginning of the spring compression is limited or with which, without a free displacement travel of the sleeve 11, an initial tension is impressed on the spring means 16, preferably a conventional Bellville spring comprised of a number of dished spring washers. A renewed locking can be effected by displacing the spindle portion 1 in the reverse direction. The tapered component surface 6 serves as a working surface of the sleeve 3 for the balls 19. By selection of a flatter angle of elevation for this tapered surface, the necessary restoring locking force can be reduced in relation to the unlocking force.

Figure 2:
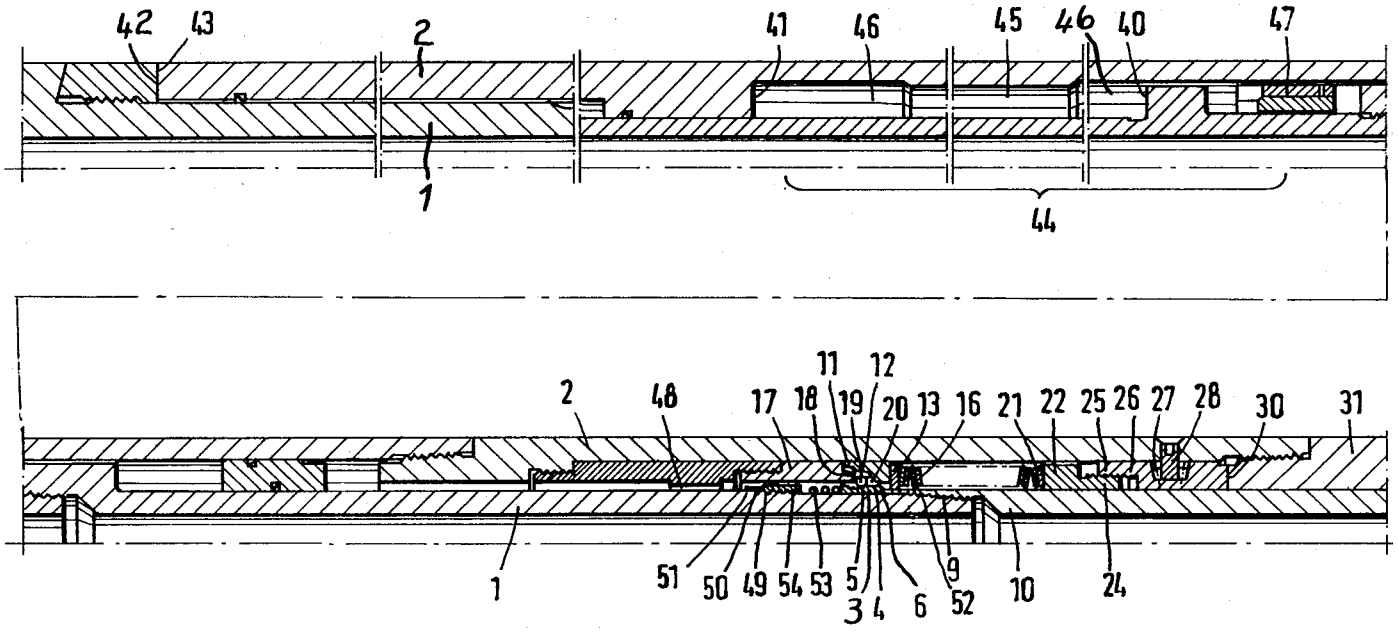
FIG. 2 is a cross-sectional view which shows a locking device as an auxiliary device for hydraulic drilling jars with irreversible behavior.

In FIG. 2, a hydraulic drilling jar with a locking means or device is illustrated in a portion of a drill string. In so far as the construction has corresponding reference numerals and the mode of operation coincides substantially with the device of FIG. 1, it will not be discussed again here.

The drilling jar has a pair of impact shoulders which serve for upwardly directed blows including a hammer 40 and an anvil 41, and a pair of impact shoulders serving for downwardly directed blows comprising a hammer 42 and an anvil 43. Furthermore, the drilling jar comprises an elongated annular chamber 44 between inner spindle portion 1 and outer sleeve portion 2 filled with a working fluid and having a constriction bore or cylinder 45 between adjoining regions 46 of larger diameter. The spindle portion 1 carries a piston 47 which can be pulled through the constricting area 45 of the chamber 44. In normal drilling operation, the drilling jar is driven and held together so that hammer 42 and anvil 43 lie against one another and the piston 47 is outside the constriction 45. The drilling jar further comprises a damping section represented by a second annular chamber including another constriction bore or cylinder 48 through which another piston 50, disposed on another part of the spindle portion 1 and bearing against a stop 49 at one side, can be drawn. The piston 50 has passages 51 extending axially at its inner periphery. The locking device as shown is in the locked state. In contrast to the form of embodiment in FIG. 1, the sleeve 3 is not fixed on the spindle portion 1 but is adapted for limited axial displacement. A limitation is formed on the one hand by a stop 52 at the end of spindle portion 10 and on the other hand is represented by a spring 53 which is adjacent to a stop 54 at either end of piston 50 or an adjacent shoulder on the spindle portion 1.

The operation and behavior of the locking device during the unlocking thereof corresponds substantially to that described for FIG. 1. However, after being unlocked an acceleration of the spindle portion 1 is effected until the piston 47 enters the constriction 45 as a result of the axial force still present after the unlocking, and a pressure peak would appear in the chamber 44 as a reaction with the sudden braking, a damping means is provided to protect the usual seals between the telescoping spindle and sleeve portions 1 and 2. The damping means enforces a slow displacement of the spindle portion 1 from the local position after the unlocking until the piston 47 enters the constriction. This is effected as a result of the fact that the other piston 50 must pass the constriction 48 during the critical displacement phase. After the unlocking, both upwardly and downwardly directed blows can be executed with the drilling jar, without the locking device engaging again. On approach of the pair of impact shoulders consisting of hammer 42 and anvil 43 and so also upon mutual contact of balls 19 and tapered component surfaces 6 of the sleeve 3, the sleeve 3 moves a limited amount axially in relation to the spindle portion 1, and compresses the spring 53 against stop 54 thereby allowing a down jar or impact to take place. Renewed locking engagement of the device requires restoring of the supporting sleeve 22 in this case, in such a manner that the spring 16 cannot build up any counter force towards the outside on displacement of the sleeve 11 as a result of giving way of the balls 19. The spring 53 is then in a position to restore and hold the sleeve 3 against the stop 52 while the balls 19 move outwards on the tapered surface 6 of the sleeve 3 on corresponding axial movement. After locking, the supporting sleeve 22 should then be restored again.

Figure 3:
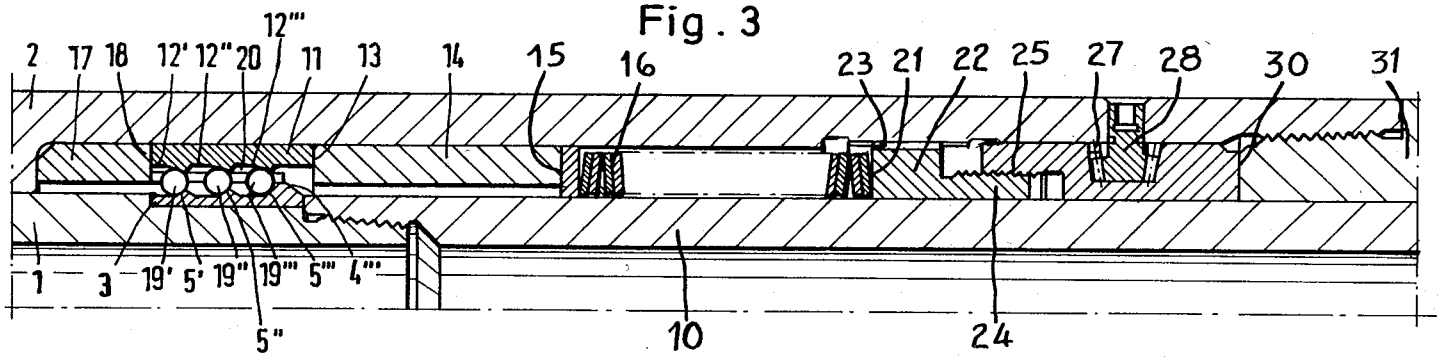
FIG. 3 is a cross-sectional view of a locking device with three locking and counter elements stratified axially.

The embodiment illustrated in FIG. 3 shows a locking device in which the locking and counter elements are trebly stratified axially. The cage 20 has three planes in which three axially enforced rows of locking balls or elements 19', 19'' and 19''' are disposed. The tapered component surfaces 12', 12'' and 12''' are correspondingly disposed on the counter element or sleeve 11 at and movable relative to the sleeve portion 2 side and the component surfaces 5', 5'' and 5''' which are likewise tapered are correspondingly disposed on the counter element sleeve 3 at and movable with the spindle portion 1 side. The sleeves 11 and 3 are preferably integral parts. The region 4''' with the larger diameter of the sleeve 3 and situated beyond or adjacent the plane of the balls 19''' is made axially as long as the greatest spacing between two planes or rows of the balls. As a result, the effect is achieved that during the unlocking, the sleeve 11 at the sleeve portion 1 side remains in the displaced position and the device does not lock in an intermediate position.

Apart from the form of embodiment illustrated here, the locking device can also be used directly as a detent device in mechanical drilling jars. It is likewise possible to use the locking device for locking a tool for direct drive by the drill string and Kelly or to equip a core drawing device for a core barrel therewith.

We claim:

1. A locking device for a telescopic tool comprising:

relatively telescopically displaceable spindle and sleeve portions including an annular chamber in which the locking device is disposed between the spindle and sleeve portions;

rollable locking elements adapted for radial displacement in the annular chamber and situated adjacent an abutment supported by one of the spindle and sleeve portions opposing and preventing axial displacement of the rollable locking elements during radial displacement thereof and unlocking of the tool;

an axially displaceable counter element with a beveled surface thereon situated on one side of the locking elements, engageable and displaceable relative to one of the spindle and sleever portions by radial displacement and engagement of the locking elements with the beveled surface;

spring means of predetermined force opposing and biasing the axially displaceable counter element and bevel surface thereon toward one side of the locking elements; and another rigid counter element with a beveled surface of sufficient rigidity to resist radial stress, carried by the other one of the spindle and sleeve portions on an opposite side of the locking elements and adapted upon the application of sufficient axial force between the spindle and sleeve portions to radially displace the locking elements against the bevel surface of and displace the axially displaceable counter element against and compress the spring means a sufficient axial distance whereby the bevel surface on and moving axially with the axially displaceable counter element allows the locking elements to move radially away from and the rigid counter element to pass by and selectively place the telescopic spindle and sleeve portions of the tool in a locked or unlocked state.

2. A locking device for a telescopic tool according to claim 1 wherein the telescopic tool is a deep well drilling jar comprising:

relatively telescopically displaceable spindle and sleeve portions with impact shoulders.

3. A locking device for a telescopic tool according to claim 1 wherein the telescopic tool is a hydraulic deep well drilling jar comprising;

relatively telescopically displaceable spindle and tubular sleeve portions with impact shoulders, a chamber filled with fluid including a constriction and region of larger diameter between the spindle and sleeve portions;

a piston on the spindle and located a predetermining distance outside the constriction when in a locked state;

valve means which when the piston passes through the contriction in one direction throttles the fluid emerging from the chamber and in the other direction allows free entrance of the fluid into the chamber, and wherein the locking device is situated in an annular compartment between the spindle and sleeve portions.

4. A locking device for a telescopic tool according to claim 3 for further comprising:

damping means on the spindle and sleeve portions for absorbing shock due to acceleration following unlocking of the locking device and sudden braking thereof on entry of the piston into the constriction.

5. A locking device for a telescopic tool according to claim 4 wherein the damping means comprises:

another constriction and another piston with narrow passages adapted to be pulled through said another constriction.

6. A locking device for a telescopic tool according to claim 3 wherein the rigid counter element comprises:

a sleeve including a pair of beveled surfaces of predetermined inclination relative to each other and an axis of the spindle which provides a constant relationship between the axial forces applied to unlock and lock the device tapering outwardly toward one another and to a region of larger-diameter carried on and displaceable with the spindle; and wherein the locking elements are disposed in a cage situated between the sleeve and the axially displaceable counter elements and adjacent a radial end surface of an abutment on the sleeve portion against which the locking elements and/or the cage bear and held axially thereby during actuation of the device from the locked to the unlocked state.

7. A locking device for a telescopic tool according to claim 6 further comprising:

a pair of axially spaced stops on the spindle, one of which is adapted to engage one end of and displace the rigid sleeve during unlocking of the device; and spring means situated and compressible between an opposite end of the sleeve and the other one of the pair of stops on the spindle for biasing the sleeve toward the one stop and allowing limited axial displacement of the sleeve relative to the spindle in one direction by the locking elements during restoring of the sleeve, spindle and locking device from the unlocked to the locked state.

8. A locking device for a telescopic tool according to claim 1 wherein the rigid counter element comprises:

a sleeve including a pair of beveled surfaces of predetermined inclination relative to each other and an axis of the spindle which provides a constant relationship between the axial forces applied to unlock and lock the device, tapering outwardly toward one another and to a region of larger diameter carried on and displaceable with the spindle; and wherein the locking elements are disposed in a cage situated between the sleeve and the axially displaceable counter element and adjacent a radial end face of an abutment on the sleeve portion against which the locking elements and/or the cage bear and held axially thereby during actuation of the device from the locked to the unlocked state.

9. A locking device for a telescopic tool according to claim 8 further comprising:

a plurality of axially disposed layers of the rollable locking elements, of the beveled surfaces of the axially displaceable counter element and of the pair of beveled surfaces of the rigid sleeve for engagement therewith.

10. A locking device for a telescopic tool according to claim 9 wherein the region of larger diameter between a pair of beveled surfaces on the rigid sleeve and situated beyond an end layer of locking elements has an axial length which is at least equal to the maximum spacing between two adjacent layers of the rollable locking elements.

11. A locking device for a telescopic tool according to claim 8 wherein the pair of beveled surfaces on the rigid sleeve have different angles of inclination relative to each other and the axis of the spindle portion whereby the axial force required to displace and unlock the spindle portion is greater than that required to lock the spindle portion.

12. A locking device for a telescopic tool according to claim 1 further comprising:

spring adjusting means adjacent the spring means for varying the spring force exterted axially against the axially displaceable counter elements and a reaction force exerted by the bevel surface thereof radially inwardly against the locking elements and hence the axial force required to lock and unlock the device.

13. A locking device for a telescopic tool according to claim 9 wherein the spring adjusting means comprises:

an axially displaceable sleeve about the spindle and keyed against rotation to the sleeve portion and having one end adjacent the spring means and an opposite threaded end portion;

a rotatable adjusting sleeve fixed against axial displacement within the sleeve portion and having one end portion threaded to the threaded end portion of the axially displaceable sleeve; and sleeve adjusting means on another portion of the adjusting sleeve for rotating the adjusting sleeve relative to the sleeve portion and axially displace the axially displaceable sleeve and which can be actuated from outside the sleeve portion.

14. A locking device for a telescopic tool according to claim 13 wherein the sleeve adjusting means comprises:

a bevel gear on the rotatable adjusting sleeve and a bevel pinion meshing with the bevel gear and rotatably mounted in the sleeve portion and adapted for actuation from outside the sleeve portion.

15. A locking device for a telescopic tool according to claim 1 wherein the rollable locking elements are balls.

* * * * *